US009086075B2

(12) United States Patent
Miller et al.

(10) Patent No.: US 9,086,075 B2
(45) Date of Patent: Jul. 21, 2015

(54) IMPELLER ASSEMBLY AND METHOD

(75) Inventors: James Miller, Sanford, NC (US); Ronald Robol, Sanford, NC (US); Rick Langlois, Apex, NC (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 1043 days.

(21) Appl. No.: 13/178,284

(22) Filed: Jul. 7, 2011

(65) Prior Publication Data

US 2013/0011268 A1 Jan. 10, 2013

(51) Int. Cl.
*F04D 29/22* (2006.01)
*F01D 5/04* (2006.01)

(52) U.S. Cl.
CPC ..... *F04D 29/2222* (2013.01); *F01D 5/048* (2013.01); *F05B 2230/21* (2013.01); *Y10T 29/53* (2015.01)

(58) Field of Classification Search
CPC ..... F01D 5/048; F01D 29/22; F01D 29/2222
USPC ..... 416/179, 182, 183, 185, 236 R, 237, 416/223 B; 29/889, 889.2, 889.23
See application file for complete search history.

(56) References Cited

U.S. PATENT DOCUMENTS

| | | | | |
|---|---|---|---|---|
| 2,902,941 | A | 9/1959 | Kiba | |
| 3,541,607 | A * | 11/1970 | Greene | 415/112 |
| 4,355,954 | A | 10/1982 | Wilson | |
| 5,143,513 | A | 9/1992 | Ellingson et al. | |
| 5,226,790 | A * | 7/1993 | Serafin | 415/208.3 |
| 5,538,395 | A | 7/1996 | Hager | |
| 6,146,094 | A | 11/2000 | Obana et al. | |
| 6,419,450 | B1 * | 7/2002 | Lum | 416/186 A |
| 6,746,210 | B2 | 6/2004 | Kim | |
| 6,805,531 | B2 | 10/2004 | Iida et al. | |
| 7,012,346 | B2 | 3/2006 | Hoffman et al. | |
| 7,070,389 | B2 | 7/2006 | Kim et al. | |
| 7,108,482 | B2 | 9/2006 | Chapman | |
| 7,121,799 | B2 | 10/2006 | Kim et al. | |
| 7,210,226 | B2 * | 5/2007 | Makinson et al. | 29/889.23 |
| 7,628,586 | B2 * | 12/2009 | Feher | 416/186 R |
| 7,804,213 | B2 | 9/2010 | Hoffman et al. | |
| 2006/0055264 | A1 | 3/2006 | Johnson et al. | |
| 2006/0056992 | A1 | 3/2006 | Sadler et al. | |
| 2006/0057005 | A1 | 3/2006 | Williams et al. | |
| 2006/0057006 | A1 | 3/2006 | Williams et al. | |
| 2006/0280609 | A1 * | 12/2006 | Ranz et al. | 416/182 |
| 2008/0199319 | A1 | 8/2008 | Mause et al. | |
| 2010/0284812 | A1 * | 11/2010 | Zahdeh | 416/185 |

* cited by examiner

*Primary Examiner* — Edward Look
*Assistant Examiner* — Juan G Flores
(74) *Attorney, Agent, or Firm* — Quarles & Brady LLP

(57) ABSTRACT

Embodiments of the invention provide an impeller and a method of producing the impeller. The impeller includes a first molded piece coupled to a second molded piece. The first molded piece includes impeller vanes, a motor hub, a nose, and an eye. The second molded piece includes a cover and a hole through the cover. The cover is coupled to the impeller vanes around the motor hub so that the motor hub extends through the hole.

18 Claims, 9 Drawing Sheets

IMPELLER ASSEMBLY AND METHOD

BACKGROUND

Conventional plastic impellers are constructed in two parts, often due to the limitations of injection molding and the specific geometries required. As shown in FIGS. 1-4, a conventional plastic impeller 10 includes a first piece 12 with impeller vanes 14, a back plate 16, and a motor mounting feature 18 (e.g., a motor hub) integrally molded together. The conventional plastic impeller 10 also includes a second piece 20 (e.g., a cover or a shroud) including an inlet nose 22 and an eye 24.

Conventional fabrication processes require a minimum of two secondary operations to form a complete impeller 10. First, the first piece 12 and the second piece 20 are mechanically bonded together. Second, the nose 22 must be machined to be concentric to the hub 18 (e.g., to a specified value A, as shown in FIG. 3). Conventional bonding processes, such as ultrasonic, vibration, hotplate adhesives, etc., use part-holding fixtures. As a result, these processes require clearances in the fixtures and their mating impeller parts, as well as clearances associated with aligning the fixtures relative to each other, in order to maintain concentricity between the hub 18 and the nose 22. Bonding processes that involve vibration and/or part movement introduce additional issues with regard to maintaining concentricity. General wear from use of the fixtures further impairs the concentric relationship between the hub 18 and the nose 22. The resulting concentricity issues are corrected by machining additional clearances into the fit between the nose 22 and a wear ring 26 of a diffuser 28, as shown in FIG. 4 (e.g., by changing value B in FIG. 3). When the impeller 10 is rotated by an electric motor at relatively high speeds, these additional clearances provide room for vibration. This can result in potential bearing damage, as well as unwanted noisy operation. In addition, these clearances provide room for internal leakage during the pumping process, as shown in FIG. 4, which reduces the mechanical efficiency of the pump.

SUMMARY

Some embodiments of the invention provide an impeller including a first molded piece coupled to a second molded piece. The first molded piece includes impeller vanes, a motor hub, a nose, and an eye. The second molded piece includes a cover and a hole through the cover. The cover is coupled to the impeller vanes around the motor hub so that the motor hub extends through the hole.

Some embodiments of the invention provide a method of assembling an impeller. The method includes molding a first piece including impeller vanes, a motor hub, a nose, an eye, and a front shroud. The method also comprises molding a second piece including a cover and a hole through the cover, and coupling the first piece to the second piece by ultrasonic welding the cover to the impeller vanes around the motor hub so that the motor hub extends through the hole.

Some embodiments of the invention provide a pool pump including a diffuser, a plastic impeller, and a wear ring. The plastic impeller is positioned adjacent to the diffuser and includes a first piece coupled to a second piece. The first piece of the impeller includes impeller vanes, a motor hub, a nose, and an eye integrally molded together. The wear ring is positioned between an outer circumference of the nose and an inlet portion of the diffuser.

DETAILED DESCRIPTION

Figure 1:
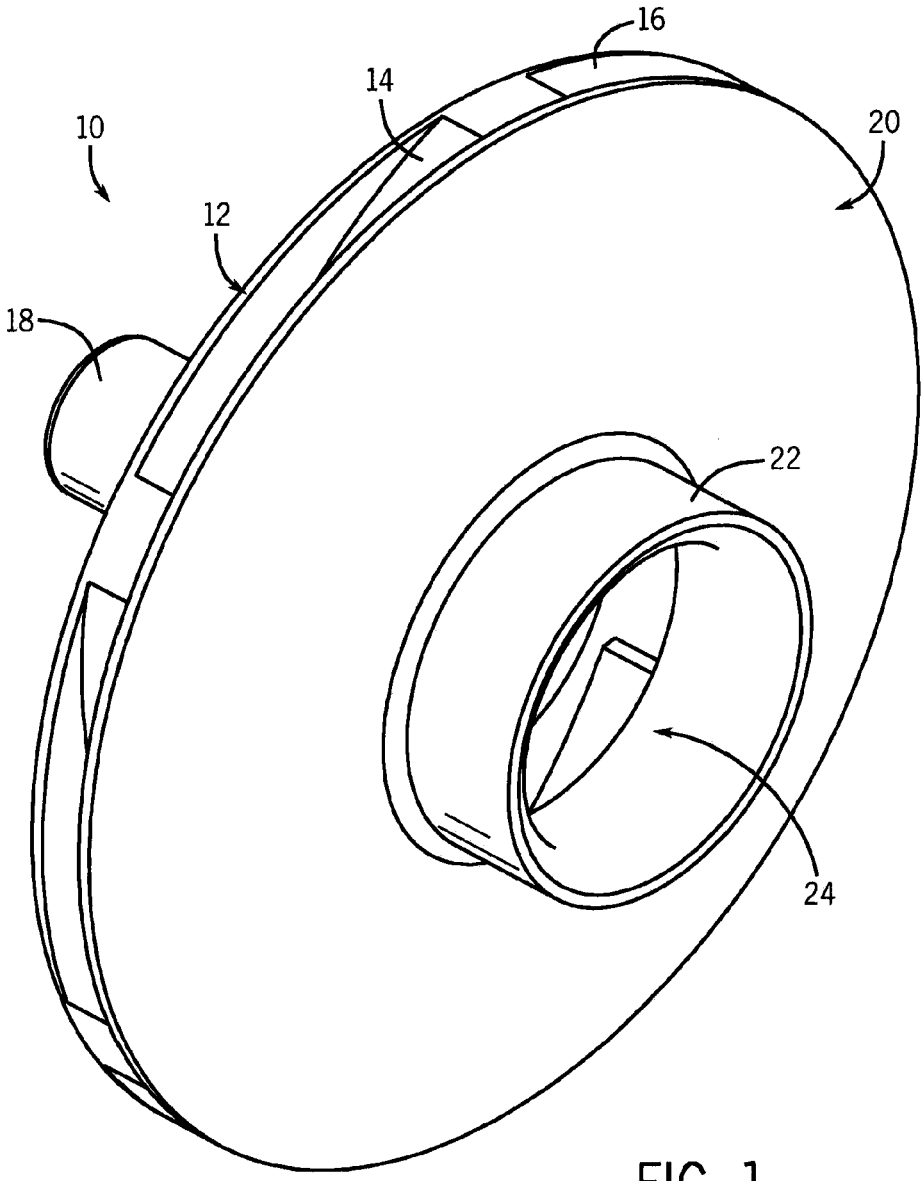
FIG. 1 (PRIOR ART)
FIG. 1 is a perspective view of a prior art impeller.
Figure 2:
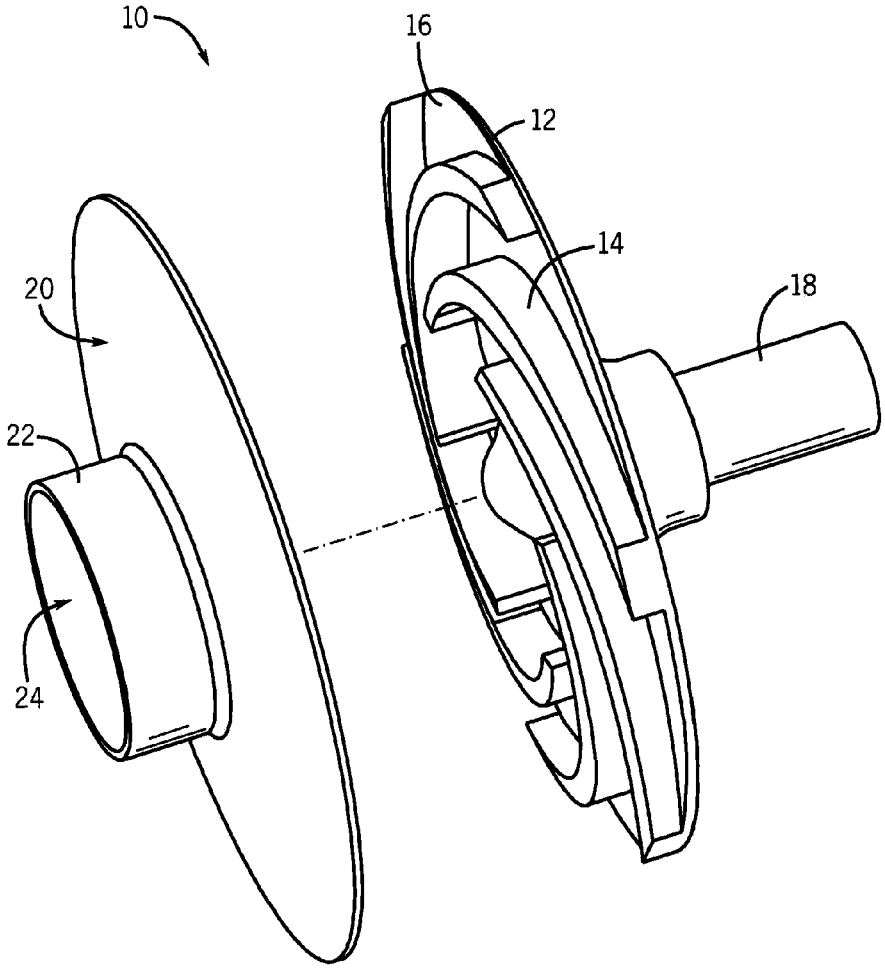
FIG. 2 (PRIOR ART)
FIG. 2 is an exploded perspective view of the prior art impeller of FIG. 1.
Figure 3:
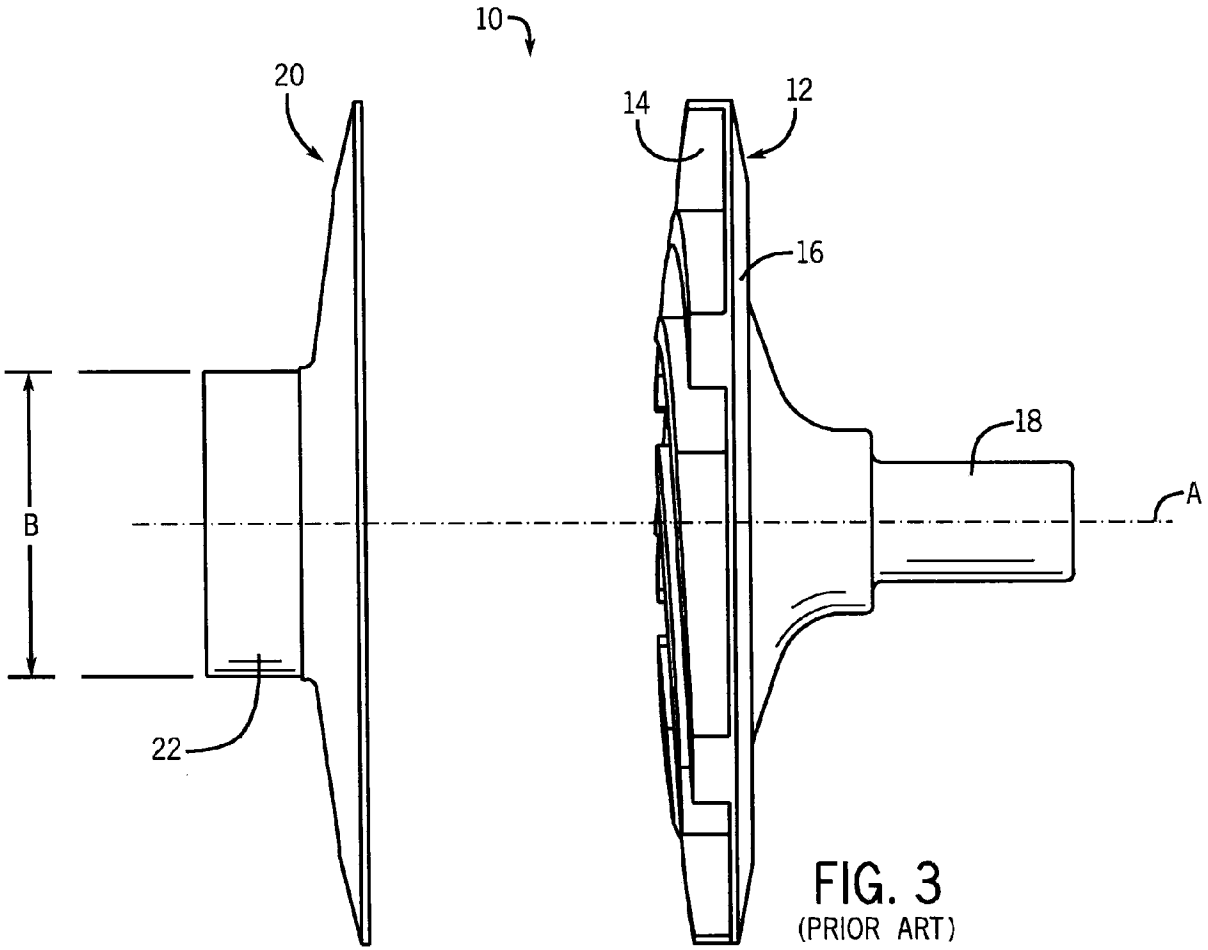
FIG. 3 (PRIOR ART)
FIG. 3 is an exploded side view of the prior art impeller of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 5:
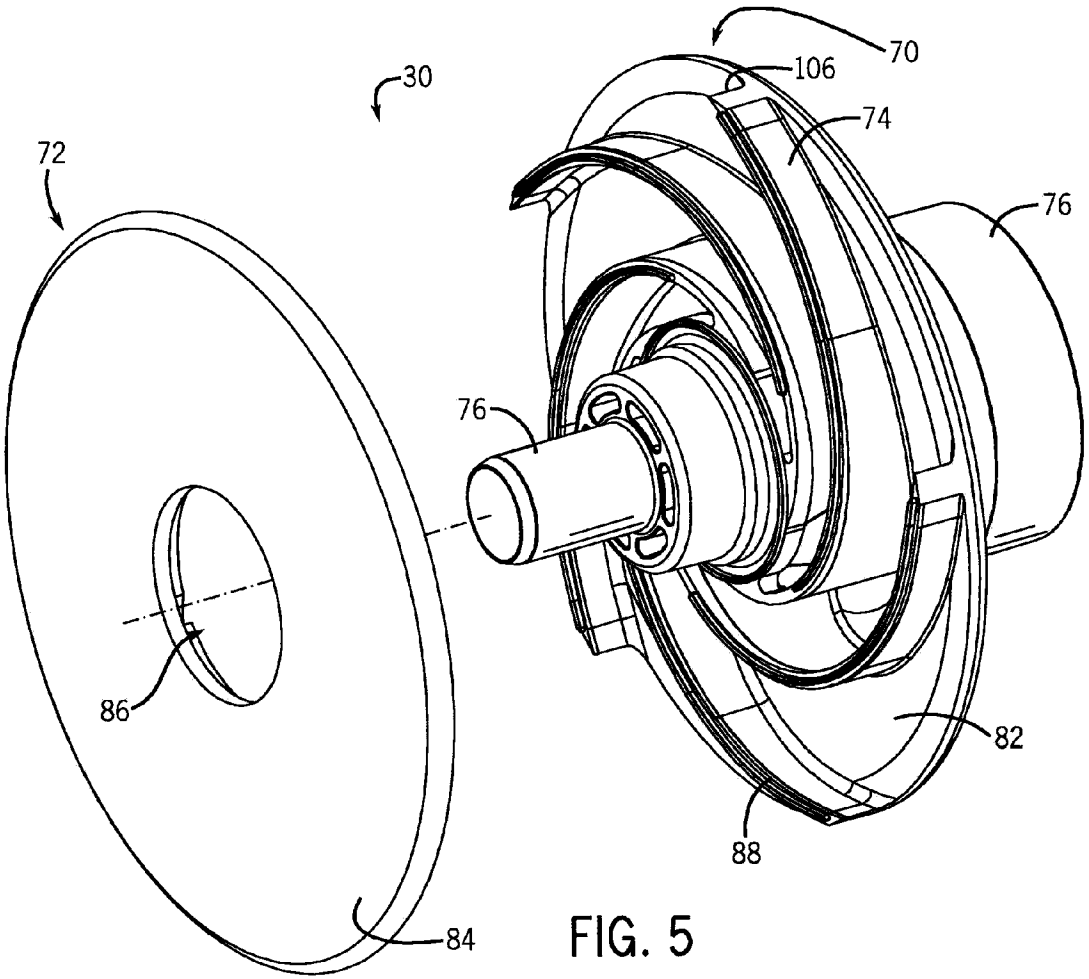
FIG. 5 is an exploded perspective view of an impeller according to one embodiment of the invention.
Figure 6:
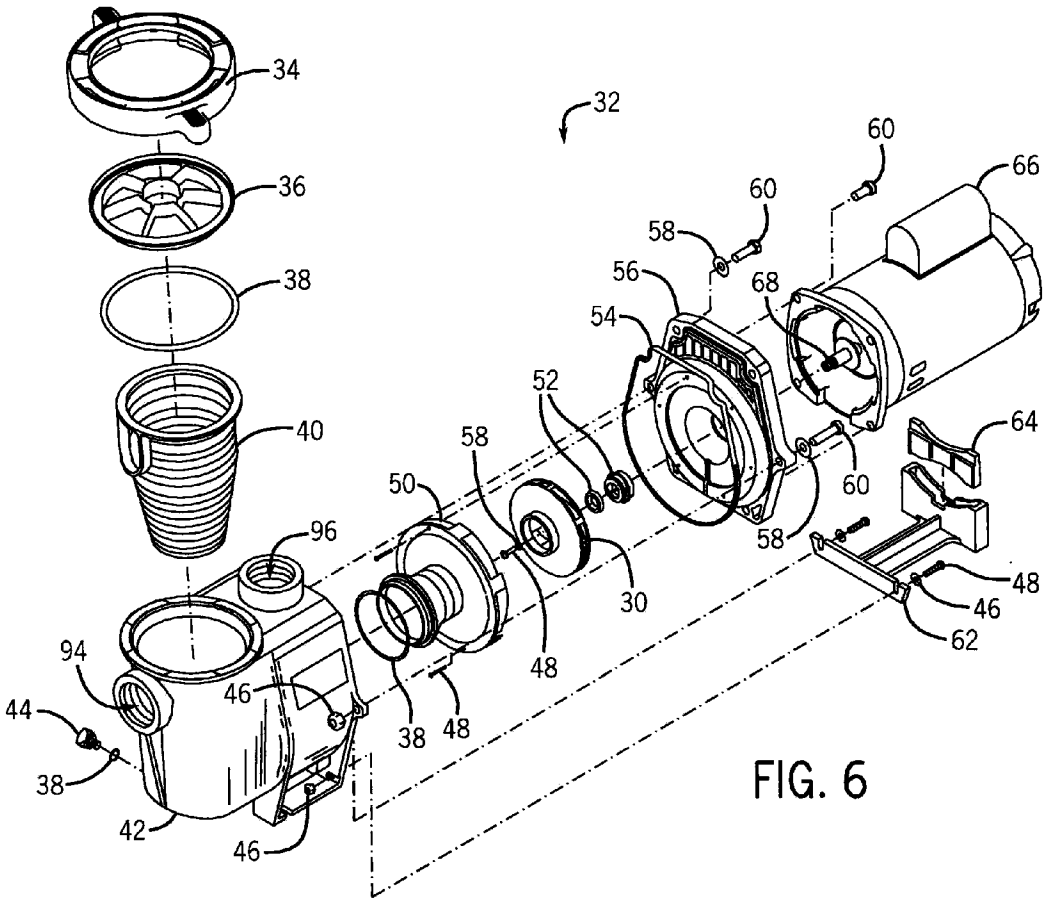
FIG. 6 is an exploded perspective view of a pump for use with the impeller of FIG. 5.

FIG. 5 illustrates an impeller 30, according to one embodiment of the invention, for use in pumps and/or fans. The impeller 30 can be a plastic impeller with a closed, single end suction design. In one embodiment, as shown in FIG. 6, the impeller 30 can be used in a pool pump 32 for commercial pools and/or residential pools. As shown in FIG. 6, the pool pump 32 can include the impeller 30, a clamp 34, a cover 36, o-rings 38, a strainer basket 40, a volute casing 42, a drain plug knob 44, nuts 46, set screws 48, a stationary diffuser 50, seals 52, a gasket 54, a seal plate 56, washers 58, bolts 60, at least one foot 62, a foot insert 64, and a motor 66. The volute casing 42 and the seal plate 56 can be coupled together to enclose the impeller 30 and the diffuser 50. A shaft 68 of the motor 66 can extend through the seal plate 56 and can be coupled to the impeller 30 to rotate the impeller 30 during operation of the pool pump 32.

Figure 9:
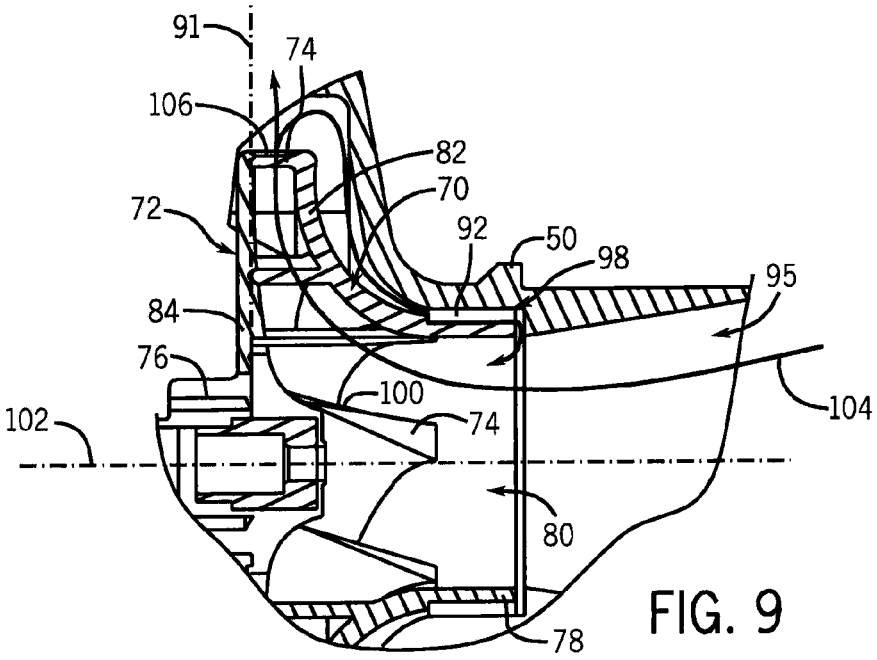
FIG. 9 is a partial side cross-section of the impeller of FIG. 5 assembled with a diffuser.

In some embodiments, as shown in FIGS. 5 and 7-9, the impeller 30 can include a primary piece 70 and a secondary piece 72. The primary piece 70 can include substantially critical concentricity features and the secondary piece 72 can include substantially non-critical concentricity features. More specifically, the primary piece 70 can include impeller vanes 74, a hub 76, a nose 78, an eye 80 (as shown in FIG. 9), and a front shroud 82, and the secondary piece 72 can include a back shroud, or cover 84. The cover 84 can include a hole 86 through which the hub 76 extends. The hub 76 can be coupled to the motor shaft 68 for operation of the impeller 30.

Figure 7:
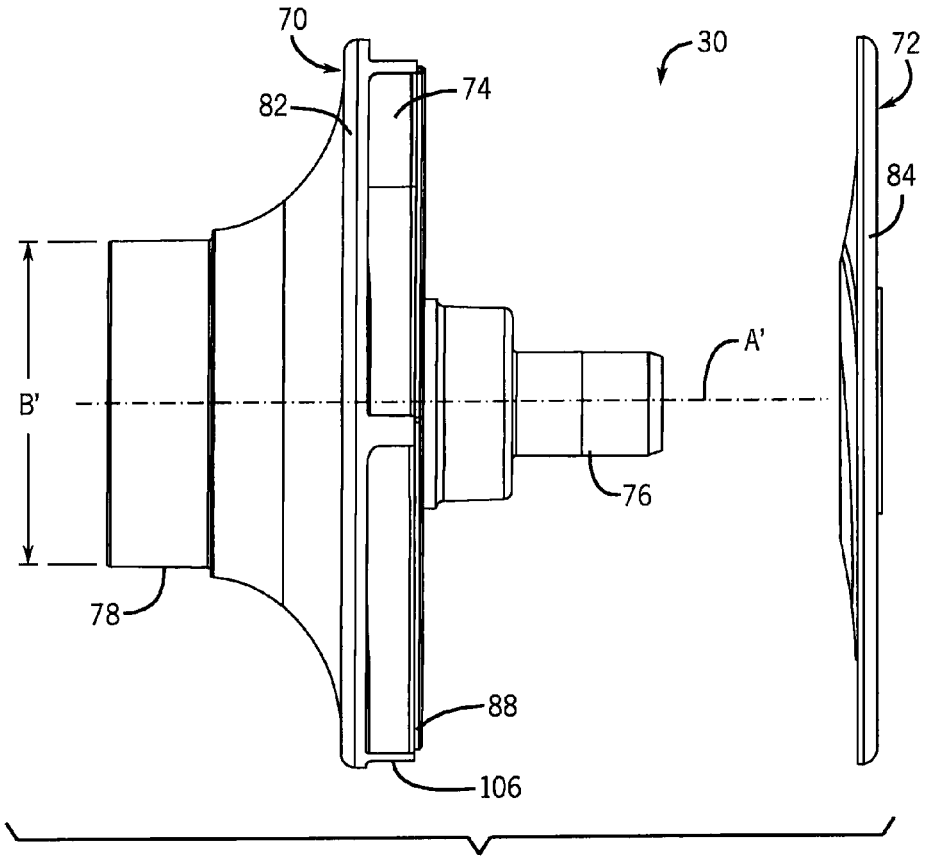
FIG. 7 is an exploded side view of the impeller of FIG. 5.

In some embodiments, both pieces 70, 72 can be separately molded (e.g., by injection molding or a similar process), and then coupled together. As a result of the impeller vanes 74, the hub 76, and the nose 78 being molded in a single piece, the hub 76 can reference the impeller nose 78 to be concentric to threads of the motor shaft 68. Further, the motor shaft 68 can also be concentric to the impeller vanes 74 as well as the impeller eye 80. The concentricity can be controlled by the tolerances associated with the plastic resin and the molding process (e.g., to a specified value A', as shown in FIG. 7), rather than the mechanical joining process, as it is done with conventional plastic impellers. This can reduce the manufacturing cost in joining the two parts together, as well as provide a more accurate process for consistent, reproducible parts. In addition, due to the greater control over the concentricity of the impeller eye 80 relative to an axis of rotation on the motor shaft 68, machining around the eye 80 of the impeller, as is often required with conventional impellers, may be unnecessary, thus saving operator time and manufacturing costs.

Figure 8:
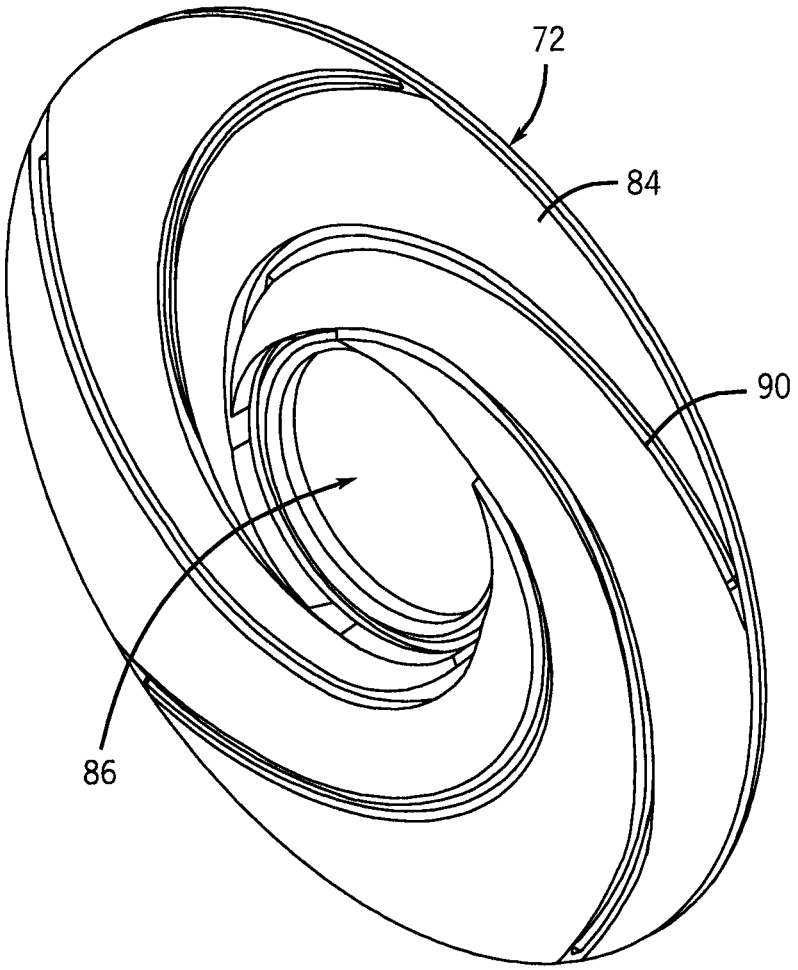
FIG. 8 is a perspective view of a piece of the impeller of FIG. 5.

In some embodiments, the edges 88 of the impeller vanes 74 (as shown in FIG. 7) can be coupled to the cover 84 along grooves 90 (as shown in FIG. 8), for example, by ultrasonic welding or a similar process. As shown in FIGS. 8 and 9, the cover 84 can be substantially flat. As a result, the point of coupling (i.e., the weld joint) between the edges 88 and the grooves 90 can be along a substantially flat plane. The ultrasonic welding process can be more precisely controlled due to the weld joint being along a flat plane 91, in comparison to the non-flat welding plane of conventional impellers. For example, as shown in the conventional impeller of FIG. 4, the impeller vanes 14 are mounted to the shroud 20, resulting in a welding plane 93 that is angled toward the nose 22 by an angle theta. As shown in FIG. 9, the flat welding plane 91 of the impeller 30 of some embodiments of the invention can result in a simplified alignment of the two pieces 70, 72 during assembly, as well as more consistent and efficient impellers. More specifically, since the depth of the weld is along a single plane 91 (i.e., rather than multiple angled planes), the welding horn can be more consistent. Also, a flat joint is easier to seat into a welding fixture and control, which can result in less flash into the flow channel of the impeller 30.

As shown in FIGS. 5 and 9, the cover 84 can be coupled to the primary piece 70 around the hub 76 so that the hub 76 extends through the hole 86 in the cover 84. A main purpose of the cover 84 can be to improve pumping performance by preventing vane bypass and to reinforce the impeller vanes 74 so that they do not flex under the stress of operation. However, the cover 84 may not be vital to the rotation of the impeller 30, resulting in the cover 84 being a substantially non-critical concentricity feature of the impeller 30. More specifically, the impeller 30 may be able to operate in a pump without the cover 84. In conventional impellers, alignment and concentricity between all pieces is vital to their rotation and they are unable to rotate without both halves assembled.

Figure 4:
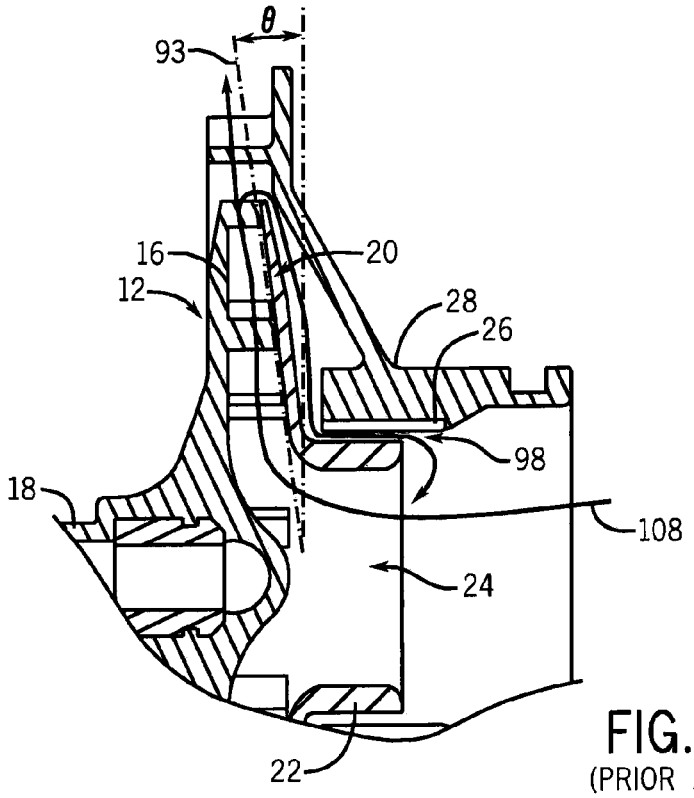
FIG. 4 (PRIOR ART)
FIG. 4 is a partial side cross-section of the prior art impeller of FIG. 1 assembled with a diffuser.

During use in a pump, such as the pump 32 shown in FIG. 6, the impeller 30 can be positioned adjacent to the diffuser 50. In operation, fluid can follow a flow path from an inlet 94 of the volute casing 42, through the strainer basket 40, through an inlet 95 of the diffuser 50 (as shown in FIG. 9), through the impeller eye 80 (as shown in FIG. 9), and radially outward from the impeller vanes 74 toward an outlet 96 of the volute casing 42. As shown in FIG. 9, a stationary wear ring 92 can be positioned between the rotating nose 78 of the impeller 30 and the stationary diffuser 50. As shown in FIGS. 4 and 9, the clearance between the impeller nose 22 or 78 and the diffuser wear ring 26 or 92 provides a primary internal leakage path 98. The size of this primary internal leakage path 98 can have a significant impact on a pump's operating efficiency because that gap allows bypass from the high pressure side of the discharge back to the inlet, requiring the bypass liquid to be pumped twice.

For example, as described above, conventional impellers 10 must be machined around the nose 22 to achieve proper concentricity with the motor hub 18. This machining causes a greater and/or uneven clearance gap 98 between the nose 22 and the wear ring 26, as shown in FIG. 4, causing vibration during rotation of the impeller 10 and increased wear on motor bearings as well as the wear ring 26. In some embodiments of the invention, the clearance (i.e., the primary leakage path 98) between the nose 78 of the impeller 30 and the stationary wear ring 92 can be reduced due to the control over the runout and concentricity, as described above. By tightly controlling the concentricity of the impeller nose 78 to the impeller hub 76 (e.g., by molding the substantially critical concentricity features in a single piece 70 and removing the need to machine the nose 78), the clearance between the impeller 30 and the wear ring 92 can be minimized (as shown in FIG. 9 in comparison to FIG. 4). This can result in less internal leakage and a more efficient hydraulic system (e.g., due to less energy being wasted pumping bypass liquid). Also, the tighter concentricity control can allow the proper balance of the impeller 30 during rotation and reduced vibration, allowing a reduction in noise and less wear on motor bearings.

Figure 10:
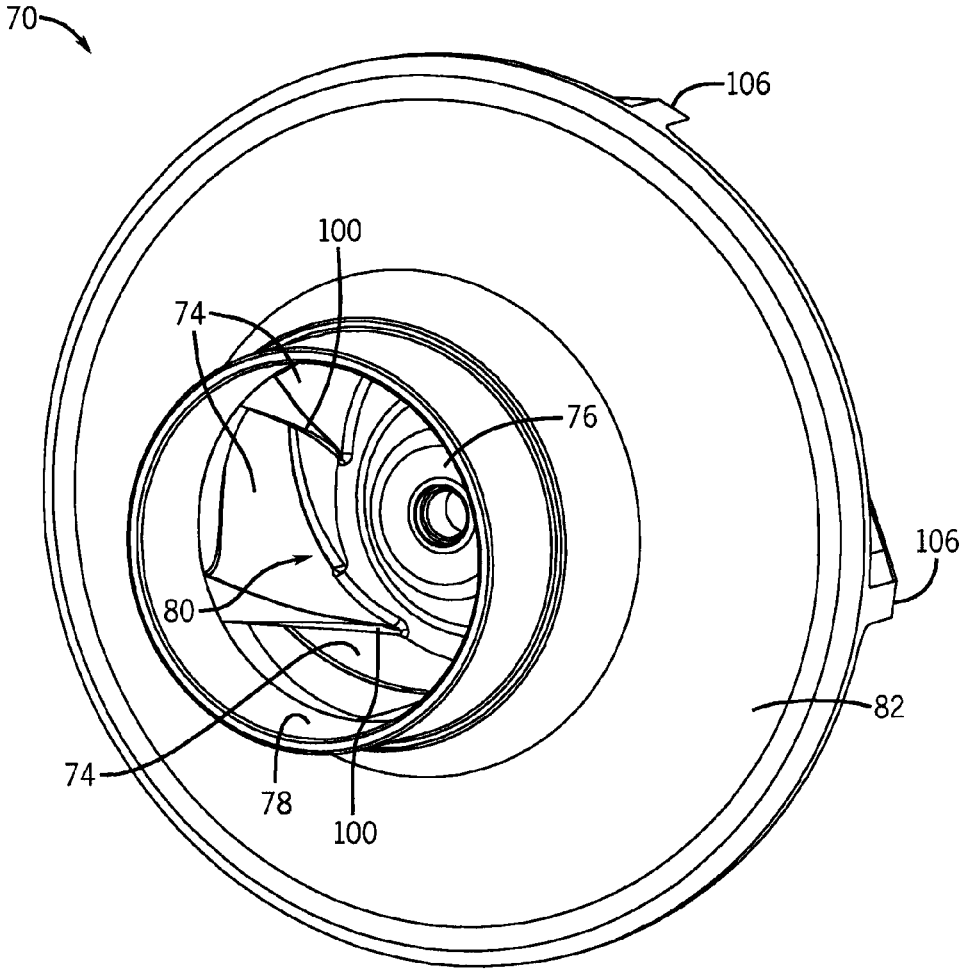
FIG. 10 is a perspective view of another piece of the impeller of FIG. 5.

In some embodiments, the impeller vanes 74 can extend outward from the front shroud 82 and/or inside the nose 78. In addition, as shown in FIG. 10, leading edges 100 of the impeller vanes 74 can extend from inside the nose 78 to the motor hub 76. The leading edges 100 of the impeller vanes 74 can be close to or approximately parallel with an axis of rotation 102 of the impeller 30. In some embodiments, the leading edges 100 can be slightly sloped inward toward the center of the hub 76 so that the fluid is swirled into the impeller vanes 74 after it enters the impeller eye 80. This is more difficult to achieve in conventional molded impellers because it produces an undercut for the molding tool.

In addition, as shown in FIG. 9, the impeller 30 can include a substantially smooth transition from the nose 78 to the front shroud 82, thus providing a smooth transition through the flow path 104 from the fluid inlet (i.e., the impeller eye 80) to the fluid discharge (i.e., radially outward from trailing edges 106 of the impeller vanes 74, as shown in FIG. 4). This can allow for a slower relative velocity change of fluid as it travels through the impeller 30 and therefore avoids uneven and drastic pressure drops that are tied to rapid velocity changes. As a result, in warmer water temperatures and lower suction pressure, the impeller 30 can provide a better performance curve compared to conventional impellers which have a flow path 108, as shown in FIG. 4, with a sharper change in direction from inlet to discharge. For example, the NPSHR (Net Positive Suction Head Required) curves of a pump using the impeller 30 of some embodiments rather than a conventional impeller can be improved due to this smooth transition.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. An impeller comprising:

a first molded piece including impeller vanes, a motor hub, a nose and an eye, wherein leading edges of the impeller vanes are one of approximately parallel to an axis of rotation of the impeller or slightly sloped inward toward the motor hub; and a second molded piece coupled to the first molded piece, the second molded piece including a cover and a hole through the cover, the cover being coupled to the impeller vanes around the motor hub so that the motor hub extends through the hole.

2. The impeller of claim 1, wherein the first molded piece is coupled to the second molded piece through ultrasonic welding.

3. The impeller of claim 2, wherein the first molded piece is coupled to the second molded piece along a flat welding plane.

4. The impeller of claim 1, wherein the first molded piece includes a front shroud, and the impeller vanes extend outward from at least one of the front shroud and inside the nose.

5. The impeller of claim 4, wherein the first molded piece is molded to provide a substantially smooth, gradual transition from the inside the nose to the front shroud.

6. The impeller of claim 1, wherein the first molded piece and the second molded piece are molded by injection molding.

7. The impeller of claim 1, wherein the first molded piece and the second molded piece are plastic.

8. The impeller of claim 1, wherein the cover is substantially flat.

9. The impeller of claim 1, wherein the cover includes grooves and edges of the impeller vanes are aligned with the grooves when coupling together the first molded piece and the second molded piece.

10. A method of assembling an impeller, the method comprising:

molding a first piece including impeller vanes, a motor hub, a nose, an eye, and a front shroud, wherein leading edges of the impeller vanes are one of approximately parallel to an axis of rotation of the impeller or slightly sloped inward toward the motor hub;

molding a second piece including a cover and a hole through the cover; and coupling the first piece to the second piece by ultrasonic welding the cover to the impeller vanes around the motor hub so that the motor hub extends through the hole.

11. The method of claim 10, and further comprising welding a substantially flat plane between the first piece and the second piece.

12. The method of claim 10, and further comprising molding the first piece so that the nose smoothly transitions into the front shroud to create a flow path along the transition with a gradual velocity change.

13. The method of claim 10, and further comprising molding the impeller vanes to extend from the inside of the nose and the front shroud.

14. The method of claim 10, and further comprising molding the first piece so that a leading edge of each one of the impeller vanes extends from inside the nose to the motor hub.

15. A pool pump comprising:

a diffuser;

a plastic impeller positioned adjacent to the diffuser, the plastic impeller including a first piece coupled to a second piece, the first piece including impeller vanes, a motor hub, a nose, and an eye integrally molded together, wherein leading edges of the impeller vanes are one of approximately parallel to an axis of rotation of the impeller or slightly sloped inward toward the motor hub; and a wear ring positioned between an outer circumference of the nose and an inlet portion of the diffuser.

16. The pool pump of claim 15, wherein the first piece of the impeller includes the impeller vanes, the motor hub, the nose, and the eye integrally molded together to minimize a clearance between the nose and the wear ring as a result of machining the nose for concentricity with the motor hub.

17. The pool pump of claim 15 and further comprising a volute casing and a seal plate.

18. The pool pump of claim 15, wherein the first piece and the second piece are coupled together by ultrasonic welding.

* * * * *